US007131471B2

(12) United States Patent
McIntosh

(10) Patent No.: US 7,131,471 B2
(45) Date of Patent: Nov. 7, 2006

(54) COMPRESSED WOOD PRODUCT AND MANUFACTURE

(76) Inventor: Trevor Ian McIntosh, 34 Sandspit Road, Waluku, Pukekohe, Auckland (NZ)

( * ) Notice: Subject to any disclaimer, the term of this patent is extended or adjusted under 35 U.S.C. 154(b) by 0 days.

(21) Appl. No.: 10/539,588

(22) PCT Filed: Dec. 22, 2003

(86) PCT No.: PCT/NZ03/00284

§ 371 (c)(1),
(2), (4) Date: Jun. 17, 2005

(87) PCT Pub. No.: WO2004/056542

PCT Pub. Date: Jul. 8, 2004

(65) Prior Publication Data

US 2006/0048852 A1 Mar. 9, 2006

(30) Foreign Application Priority Data

Dec. 20, 2002 (NZ) ..... 523295

(51) Int. Cl.
*B27D 1/00* (2006.01)

(52) U.S. Cl. ..... 144/348; 144/351; 144/352; 144/380

(58) Field of Classification Search ..... 144/344, 144/348, 351, 361, 362, 380, 352, 329, 332, 144/346; 428/106, 107, 537.1; 427/351
See application file for complete search history.

(56) References Cited

U.S. PATENT DOCUMENTS 2,101,542 A * 12/1937 Hartzell ..... 144/380
2,303,916 A * 12/1942 De Samsonow ..... 156/281
2,770,272 A * 11/1956 Morrison ..... 144/348
2,772,197 A * 11/1956 Kozdemba ..... 156/331.3
3,977,449 A * 8/1976 Sadashige ..... 144/351
4,606,388 A * 8/1986 Favot ..... 144/361
6,667,429 B1 * 12/2003 Abe et al. ..... 84/1

FOREIGN PATENT DOCUMENTS

JP 51109978 A * 9/1976
JP 08155917 A * 6/1996

* cited by examiner

*Primary Examiner*—Bena Miller
(74) *Attorney, Agent, or Firm*—Jacobson Holman PLLC

(57) ABSTRACT

The invention described is a method for compressing wood products in a manner which achieves fixation of compression deformation. The method includes two compression stages. In between those stages the wood is coated and impregnated with a fatty acid. The wood, after the second compression step is annealed to set the compressor. The product may be used for flooring, panelling and for making wooden articles.

24 Claims, 2 Drawing Sheets

COMPRESSED WOOD PRODUCT AND MANUFACTURE

This is a nationalization of PCT/NZ03/000284 filed Dec. 22, 2003 and published in English.

TECHNICAL FIELD

This invention relates to manufacturing a compressed wood product. More particularly it relates to a process for manufacturing a compressed wood product where the compression of wood fibres is permanently fixed.

BACKGROUND ART

It is known in the art that both softwood and hardwood can be compressed into densified and hardened products. There are many ways of achieving this including the use of heat, steam, pressure and chemicals including adhesives. The objective of a process of wood deformation is to achieve both densification of the wood and permanent fixation of the densification in the product in a manner which is efficient and has minimal effect on the environment.

A discussion of possible ways in which to achieve permanent fixation of compression deformation of soft wood is found in Inoue (see reference). The author of that paper suggested that three methods to permanently fix the compression deformation of wood. The first was to make wood inaccessible to water using acetyl groups. The second was to form cross-linking between wood components using paraformaldehyde. The third was to release elastic energy stored by deformation by dipping compressed wood in acidic acid and hydrochloric acid.

In U.S. Pat. No. 3,981,338 there is described a method of compressing debarked and dried logs in a mould where they were immersed with a liquid adhesive. The logs were compressed in the mould to a thickness smaller than that finally required. They were then allowed to expand while still immersed in the adhesive and compressed to the final desired thickness and subjected to an elevated temperature to allow the adhesive to harden.

In U.S. Pat. No. 4,606,388 there is described a method of compressing low density woods. A wood member in a green state is subjected to ammonia to plasticise it to a sponge-like form. It is then subjected to a series of compression cycles and dried.

In published Japanese application Nos. JP 10-217210; JP 11-114915; and JP 11-320510 there are described methods of forming pressed wood using high pressure compressing devices.

In U.S. Pat. No. 5,343,913 there is described a method of compressing wood involving softening the wood at high temperature and high water vapour temperature and then compression moulding the wood to reduce it to one half to one third of its original thickness. The compression is fixed by maintaining wood in a compressed stated for a predetermined period of time.

It is an object of this invention to provide a method of manufacturing densified wood with permanent fixation which is an alternative to the above described methods or at least to offer the public a useful choice.

DISCLOSURE OF INVENTION

Accordingly the invention may be said broadly to consist in a method of forming a compressed wood product comprising the steps of:

subjecting a piece or pieces of softwood, with a moisture content of approximately 30–40% (w/w) to a first heated compression step in which the density of the softwood is increased to a first predetermined level and the moisture content is reduced to between approximately 3–8% (w/w), releasing said wood from said first compression step, coating and impregnating said compressed wood with a fatty acid, subjecting said impregnated compressed wood to a second heated compression step in which the density of said compressed wood is increased to a second predetermined level and the moisture content is further reduced and in which said fatty acid is further impregnated into said compressed wood, and releasing said wood from said second compression step and allowing said impregnated compressed wood to anneal while cooling to ambient temperature.

In another embodiment, the invention may be said broadly to consist in a method of forming a compressed wood product comprising the steps of:

subjecting a piece or pieces of diffuse porous hardwood, with a moisture content of approximately 40–50% (w/w) to a first heated compression step in which the density of the hardwood is increased to a first predetermined level and the moisture content is reduced to approximately 4–8% (w/w), releasing said wood from said first compression step and coating and impregnating said compressed wood with a fatty acid, optionally, when said wood is hardwood, subjecting said impregnated compressed wood to a second heated compression step in which the density of said compressed wood is increased to a second predetermined level and the moisture content is reduced to suit end product requirements, at as low as 2–4% (w/w) and in which said fatty acid is further impregnated into said compressed wood, and releasing said wood from said second compression step and allowing said impregnated compressed wood to anneal while cooling to ambient temperature.

Preferably when said wood product is softwood, said softwood is subjected to a preliminary drying step prior to said first compression step.

Preferably when said wood product is hardwood, said hardwood is subjected to a preliminary drying step prior to said first compression step.

Preferably said preliminary drying step is a pressure drying step.

Preferably said first compression step is maintained for a time period of up to five minutes.

Preferably said first compression step is conducted at a pressure of from 50 to 114 kg/cm$^2$ according to wood species.

Preferably the temperature of said first compression step is within the range of 140° C. to 185° C.

In one alternative when said wood is softwood it maybe subjected to steam heat or any other heat at a temperature up to 200° C. prior to said first compression step.

Preferably said compressed wood is impregnated by passing it through a heated bath only, or in combination in vacuum pressure chamber.

Preferably said bath or pressure tank is heated to a temperature of from about 60° C. to 120° C.

Preferably said fatty acid is in a non-aqueous carrier.

Preferably said non-aqueous carrier is paraffin.

In one alternative said fatty acid is stearic acid.

In another embodiment said fatty acid is palmitic acid.

In another alternative the fatty acid is a mixture of palmitic and stearic acid.

Preferably said second compression step is conducted at a temperature between 60° C. and 140° C.

Preferably said second compression step is conducted for from 3 to 6 minutes.

Preferably said annealing is assisted by subjecting said compressed wood from said second heated compression step to radiation.

Preferably said radiation is infrared radiation.

In one alternative said radiation is microwave radiation.

In a second alternative said radiation is gamma radiation.

Preferably the process includes the preliminary step of cutting a log into pieces.

In one embodiment said pieces are flitches.

Preferably said flitches are sliced.

In another embodiment said flitches are subjected to infrared radiation prior to being sliced.

In another embodiment a log is cut into side slab wood with predetermined thicknesses which establish flitch size parameters.

Preferably when a said log is diffuse porous hardwood said flitches or slabs cut therefrom are stored for up to four weeks prior to further treatment.

In one alternative, said wood is subjected to a preliminary step of immersion in hot water or superheated steam.

Preferably said wood is subjected to a preliminary drying step to reduce its moisture content prior to steam heating and before said first compression step.

In one embodiment said drying step is reduced pressure drying.

In one embodiment said compressed wood product after annealing is subjected to a further drying step.

In a further alternative said further drying step is followed by a supplementary packet assembling compression step.

Preferably said assembling compression step is done at ambient temperature.

In another alternative said compressed wood from the said assembling compression step is subjected to further processing.

Preferably said further processing includes laminating compressed pieces of the modified wood together, or with other wood fibre panels.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

The invention may be more fully understood by having reference to the accompanying drawings in which.

MODES OF CARRYING OUT THE INVENTION

Log Processing—Wood Preparation

In this specification the expression "moisture content" means the weight of water expressed as a percentage of the dry weight of wood containing the water.

Figure 1:
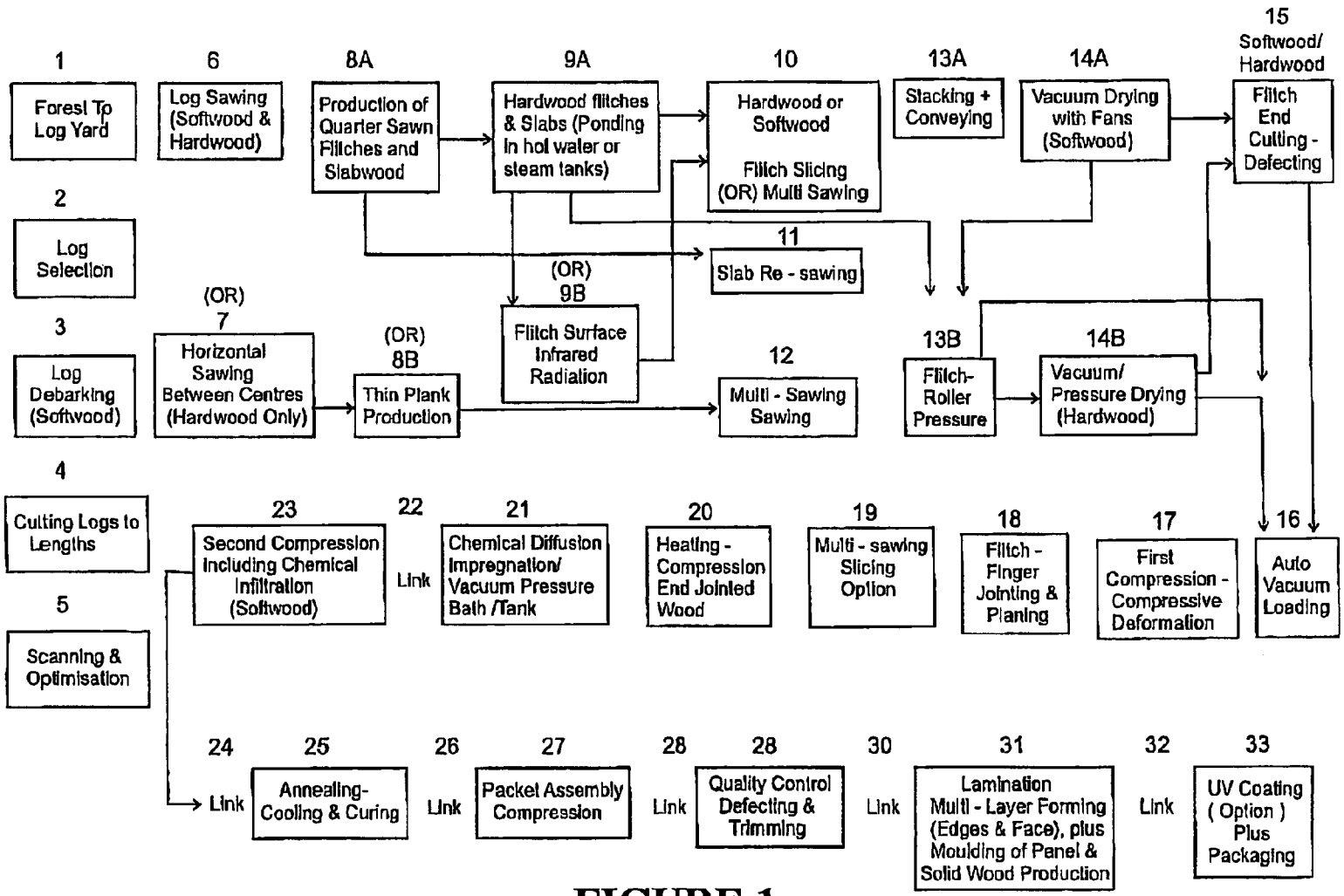
FIG. 1 is a flow diagram schematically outlining the processing steps of a preferred embodiment.

Referring to FIG. 1, step 1 is the transport of cut logs to the log yard. Step 2 is the selection of the logs. Where the wood chosen is *pinus radiata* or other softwood species clearwood buttlogs of up to approximately 5 to 6 meters in length are chosen In another alternative, logs which have long internodel spacing between the branches are chosen. Using log optimisation computer programs it is possible to select cut lengths between knots.

It is also possible to select younger trees where it is intended that the knots are processed in accordance with one aspect of the invention.

Step 3 is the debarking of soft wood logs which is carried out in a conventional way well known in the art.

Step 4 is cutting the logs to length. The method of cutting is conventional to saw mills. The lengths chosen are determined by the scanning and optimisation software.

Use of a scanning and optimisation software is shown at Step 5 of FIG. 1. Selected logs are scanned and optimised by both log end scanning and a three dimensional all round log measuring device to assist in the log being sawn to specified flitch cutting patterns. This technology also provides for cutting useful wood portions out of low grade logs or defective portions of a log. The log input data can also be related to the product output volumes. The process is under continuous monitoring so as to optimise production using commercially available software packages to do this.

A first log sawing step 6 can be carried out by the preferred method of computerised log scanning and optimisation to establish the flitch cutting patterns based on the relationship of the softwood core wood diameter and the slabwood widths to maximise on the wood recovery of each log according to product requirements.

Figure 2:
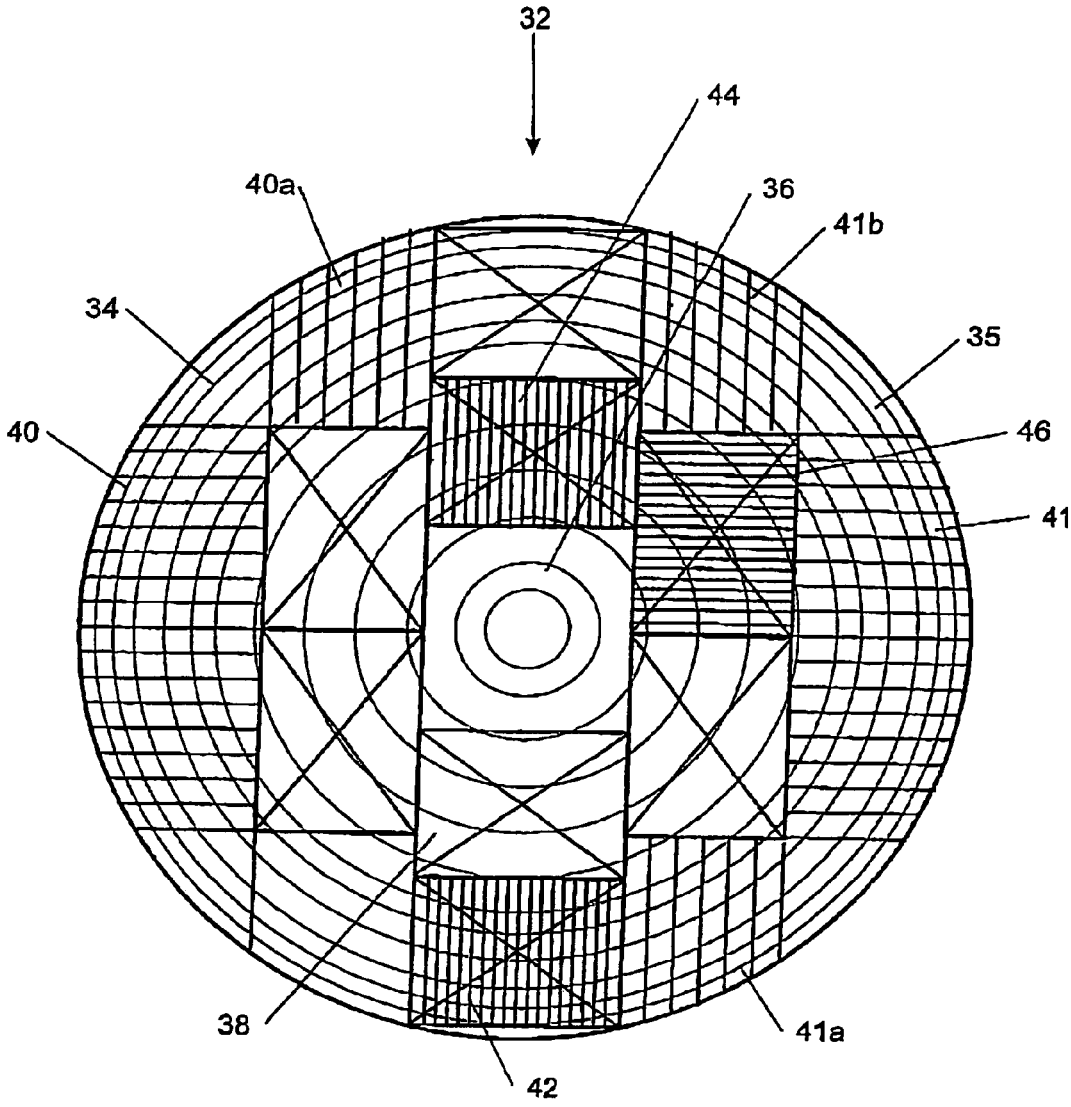
FIG. 2 is a cross-sectional end view of a debarked log sawn to produce pieces of wood to be compressed according to the process of this invention.

FIG. 2 illustrates how flitches are sawn at stations 6, 7, 8A or 8B to provide for optimised "wider section" slabwood as compared to standard flitch cutting. Wider section flitches may be cut according to varied cutting patterns to produce specific quarter sawn flitch widths, and also thicknesses of slabwood to suit production schedules.

A log 32 as illustrated in FIG. 2 is subjected to saw cats illustrated by the solid straight lines. The main pieces of slabwood to be quarter sawn are produced on the left and right sides and are numbered 40 and 41. At the centre of the log is the corewood 36. There are other flitches 38 (only one of which has a reference numeral) immediately surrounding corewood 36.

Slabwood may be cut into smaller pieces such as are illustrated by the small corner segments 34 and 35. Also illustrated are small segments of slabwood such as 40*a*, 41*a* and 41*b*. Small corner pieces such as segments 34 and 35 will be cut to a minimum saw width of 50 mm. The remainder is slabwood waste which is either chipped or used as fuel. The flitches 42, 44 and 46 in FIG. 2 are all quarter sawn sliced wood as referred to in FIG. 1 which are advanced for slicing at position 10.

This method of log breakdown provides for the cutting of *pinus radiata* softwood logs by targeting the clearwood at the base of the log, achieved by log pruning regime, so as to utilise by this process 2 to 6 meter log lengths to achieve maximum wood utilisation and quality. The process also provides for the modification and upgrading of the core wood so as to integrate this material as suitable substrate for the modified high value outer wood panel claddings, and also to laminate the modified corewood into structural products. Alternatively, other fibreboard options or other suitable material (metal or synthetic) may be used as substrates.

Two alternative optional steps which assist in the preparation of wood for subsequent processing may be carried out as illustrated in stages 9A or 9B. In stage 9A hardwood flitches or slabs may be soaked in hot water, "ponding", or steam to soften the wood. Alternatively the flitch surface in stage 9B maybe heated by using infrared radiation.

This wood heating step further breaks down the residual wood fibre to assist in maximum penetration of the fatty acid compounds in both the heated bath and/or the vacuum pressure chemical impregnation step 21.

These steps help achieve fixation of the wood fibre cell structure and also provide increased dimensional stability. The modified wood is suitable for subsequent applications of adhesives and also UV pigmented clear surface coatings designed to block UV radiation. The process designed to lessen the breakdown of the wood surface. The compressed wood has increased strength somewhat in proportion to the compression, and greater than that when the modified wood is laminated into layers.

In one alternative a log is sawn in flitches, which are then either multi-blade sawn or sliced at sawing/slicing stations 10 or 19. In another alternative selected width slabwood piece from the sawn log is re-sawn at the sawing station 11.

An alternative hardwood sawing method comprises the reduction of a log to short lengths, eg 2–3 meter log lengths using a log "centre drive" horizontal log band saw. Such a saw has an automatic adjustment of the height of log table to provide for continuous thin cutting sequence and automatic log turning to cut to a specific thickness range. The subsequent cuts from this step are to width by a multi-saw at station 12.

The various cuts are then stacked at station 13A and conveyed to the next stage.

Wood Drying

The slices of wood are then optionally dried. In a preferred embodiment the drying is conducted in vacuum driers 14A or 14B where the drying may be assisted by use of superheated steam in conjunction with a vacuum.

The preferred method of pre-drying the softwood is to dry of both the wood flitches and edged slabwood in a vacuum dryer with fans, and with the wood placed in layers between wood or plastic fillets. This done at station 14A.

The preferred method for pre-drying diffuse porous hardwood is in a vacuum/pressure dryer with heated plates between each wood layer, and with constant top pressure to accommodate the wood shrinkage during drying. This is done at station 14B.

The sawn wood strips and the re-sawn lumber may be dried to the preferred moisture content range of approximately 40–50% (W/W) for diffuse porous hardwood, and 30–40% (W/W) for softwood.

In station 14A, which has a vacuum drier with fans, layers of wood are separated by wooden or plastic fillets to encourage the movement of the super heated steam through the layers of timber. This movement provides advantages in the drying of softwood (such as *pinus radiata*) and especially for large flitch sizes. Tis method may be preferred where the multiple slice/sawing option 15 takes place after this drying process. The moisture content of *pinus radiata* which is normally in excess of 140–150% (W/W) is reduced in this pre-dry step to approximately 35–40% (W/W) in readiness for the next sawing and compression stages.

A vacuum press/dryer suitable for carrying out a pre-drying step in station 14B is a square section vacuum drying oven which is operated at a temperature up to normally 80–90° C., and with vacuum of approximately 150–200 Mbar absolute pressure in the dryer. As a result of the vacuum, moisture is removed from the wood from the centre outwards (opposite to conventional drying). The water evaporates and becomes super heated steam, which, because the drying is in an oxygen free atmosphere, ensures the wood remains a light colour.

During this pre-drying step it is preferable to apply a constant top pressure to the wood layers. In addition, heated plates are provided between each layer to keep the wood flat and straight. A preferred pressure of up to 10,000 kg per sq. mtr. of wood surface to help compensate for wood shrinkage. This pressure also assists in avoiding cellular collapse during this first stage drying on hardwoods prior to the first compression step 17.

The steam created during this step between the heated plates and the heated lumber keeps the wood surface wet during the drying process. The computer control settings are adjusted according to the wood species to obtain accurate moisture settings. When diffuse porous hardwood is pre-dried the moisture content is reduced preferably to 40–50% (W/W) in readiness for the next compression stage.

Both the vacuum/pressure drying at station 14B and the vacuum drying with fans at station 14A cause evaporation of turpentine in the wood resins. A small portion of chemical extracts, such as beta pinene, may be separated at the outfall of the dryer. The resins come to the surface of the wood as a friable sugary substance, which is easily removed. This drying method gives an even light surface colour to the product and also provides good adhesion for subsequent lamination. It also allows for even coverage of surface coatings on the products of this invention.

Alternative Sawing Step

At station 15 softwood flitches may be cut into slices (such as slices 42, 44 and 46 in FIG. 2) after the drying stage 14A. This is an alternative to the operation at step 10 described above.

Where the flitches are from logs with knots (such as *pinus radiata*) they are also cross-cut and end jointed to predetermined lengths. These are then combined with flitches of the desired length for later stages of the processing.

At stage 16 the pieces cut to length at stage 15 are lifted in layers by an overhead gantry and advanced to the first compression stage 17. The gantry is preferably equipped with a vacuum clamping mechanism known in the art.

First Compressive Deformation

After the initial partial drying of the wood, at stations 14A or 14B depending on the wood species, the wood is subjected to compression at station 17. For diffuse porous hardwood lumber with a pre-compression moisture content of 35–45% (W/W) the compression will be in the range of 25 to 40% of the starting wood thickness.

For compression of partially dried softwoods with a pre-compression moisture content of 40% (W/W), less compression will be used, so as not to close the wood cells completely, and for such wood a compression factor of approximately 20–30% will be used.

The pressure and heat required for such compression is based on the following:

Thin wood strips or blocks are conveyed at up to 40 mpm, between two heated platens of 250 mm thickness used for both strength and accurate heat dispersal. Either hot oil or steam may be used as a heating medium. The temperature is maintained at a preferred range of up to 180° for softwoods, and up to 200° C. for the hardwoods. A special steel conveyor may be used at the higher pressure.

In another embodiment for the compression of softwood with knots in the wood strips a replaceable compression mat would be used. The mat is suitable for both heat transference, and with sufficient elasticity of the surface for the variable positioned knots (normally harder than the surrounding wood), to be compressed into.

The compressive forces suitable for hardwood compression will be up to approximately 96 kg/cm$^2$ and for softwoods a pressure up to 60 kg/cm$^2$. The plates are hydraulically actuated.

A compression apparatus machine suitable for use at station 17 is equipped with a shake function for ease of wood removal after the compression process, and to provide for automatic out feeding from the heated plates. The machine is provided with a multistage compression device to avoid blow outs of the wood during the compression process. The machine includes spacing bars to be set for the variable wood thicknesses as required. The machine is also controlled by computerised depth settings which can be programmed according to wood species and moisture content.

The compressive process on hardwoods can take place either from "green sawn" (wood processed directly after log sawing) or after the preying process at stations 14A or 14B. In both cases sufficient pressure and heat are used to bring the moisture content down to approximately 4–6% (W/W) prior to the next stages of the process.

Once the wood strips are removed from the compressive deformation chamber, owing to the heat and pressure, the wood is in a malleable—softened state. If knotty wood is compressed it is subjected to a surfacing/calibrating process prior to the next stage.

Bound water in the convoluted cellular structure of difficult to dry timbers, such as the New Zealand nothofagus beech species and fast growing eucalypt hardwoods is removed by this step. Both types of wood are prone to cellular collapse during conventional drying processes.

In another embodiment there is provided a pre-compression stage (13B), using a set of stainless steel heated conveyor pressure rollers which apply constant pressure up to 40 kg/cm$^2$ or as specified according to the wood species. This preliminary step releases the wood tension from the convoluted cell structures prior to the hardwood vacuum/pressure drying, 14B. This energy release is applicable to timbers which have a tendency towards cellular collapse during normal wood drying processes. Also, after the flitch-softwood drying, for additional removal of wood resins, this roller pressure option is available. The heated rollers may be up to 500 mm in diameter and comprise 2 or 4 sets of counter rotating rollers with either knurled or grooved surface to facilitate removal of the moisture during this initial compression step.

At stage 18 the lengths of wood from first compression stage 17 are, in one embodiment, end jointed to one another. The preferred method is finger jointing. The joints are glued, clamped and cured. The joined lengths are then planed.

At stage 19 the extended length flitches from stage 18 are sliced or sawn lengthwise to the desired thickness. This may be done using a multi-bladed saw for convenience. This option is most advantageously done with softwoods. For high density hardwoods the multi-sawing is preferably done at stage 10.

Hardwood from first compression stage 17 is preferably fed directly from stage 17 to the impregnation stage 21. Softwood is preferably subjected to stages 18 to 20 before being advanced to impregnation stage 21.

Chemical/Diffusion/Impregnation

The compressed wood from stage 17 is loaded either manually or automatically into a heated bath of fatty acids, preferably in a paraffin carrier in stage 21. The bath or tank is preferably heated to a temperature of from 60° C. to 120° C. Preferred fatty acids are stearic or palmitic acids, but other fatty acids may be used. The fatty acids provide increased wood hardness and water repellency. Optionally a staining agent may be added to produce wood colour variation, such as teak, mahogany etc in the product. Wood preservatives and other chemical additives may be included in the bath 21. Preferably the bath chamber is subject to a vacuum pressure.

Second Compressive/Densification Step

Impregnated compressed wood strips are removed from stage 21, and are conveyed via link 22 on multi-rollers into heated compression plates at second compression stage 23. The plates have a high pressure liquid injection system for additional supply of chemicals. Downstream of the pressure plates are high density spiral rubber (90 Shore hardness) pressure rollers. These rollers serve to squeeze excess chemicals from the wood. A chemical recovery bath is provided below the rollers to allow for continuous processing.

The wood is subjected to pressure within a range of approximately 20–30 kg/cm$^2$ at a temperature ranging between 60–120°. This is the second compressive process, during which both densification pressure plates and chemical spreader rollers are employed to achieve mechanical pressurised chemical impregnation to consolidate the chemicals into the wood as a continuation of the impregnation step 21. This step is continued for up to about 6 minutes.

The product is conveyed via link 24 from the second compression stage 23 to annealing stage 25.

The second compression step is used for softwood and up to medium density hardwoods. It is optional for hardwood.

Moulding

In an alternative embodiment the second compression step formers can be used to mould compressed wood strips into desired shapes in top and bottom heated moulds (male and female jigs). The moulds are preferably either electrically or hot water heated but may be heated with other heating media for the forming process.

The process can take place either before or after the annealing and curing step 25. Adhesive may optionally be applied to the wood surfaces to enable bonding to take place in the formed product as a result of the compression process.

Within the same step, and prior to the compression, the edges of the wood strips may be straightened and taped together in readiness of the forming/compression step.

Following the chemical/fatty acid impregnation of the pre-modified wood strips, additional surface chemical applications are targeted to provide water resistance. The moulded products may be in the shape of plates, bowls or other similar articles. In other applications the moulds are shaped as furniture pieces.

Annealing

In stage 25 the compressed wood is dried in a continuous feed forced air or infrared drying oven. Wood strips are placed on trays which are fed by a conveyor vertically through an oven. During this stage the compressed wood is annealed into a permanently compressed product. The strips are stacked once discharged and held for sufficient time for the final curing.

Final Compression

The annealed products are passed through link 26 to stage 27 where a cold pack press is used to ensure the wood is held in an ordered stack in preparation for subsequent processing. The layers of the compressed modified wood are interleaved with release layers, such as wax paper, between each layer of the wood, thereby preventing any surplus chemical residue from spreading between layers. Layer upon layer of the compressed/modified wood are stacked for transport by using bottom and top boards to cover the total stack length and width (which could be 6 meters length×1.2 meters width), and with a pack thickness of as much as 1.2 meters. The top and bottom wood panels are clamped together by mechanical locking clamps, with compression bars across the wood surface so that when the press is opened, the pack is rolled out of the press in readiness for a further load. The packs are preferably kept under these clamps for a period of up to approximately 12 hours.

They are conveyed by link conveyor 28 to the inspection and quality control stage 29.

Quality Control

In quality control stage 29 manual inspection of the modified wood strips takes place, and defects are either patched, or the work pieces are cut to lengths not containing the defects.

Further Processing

The product is then conveyed via conveyor 30 from the quality control section to the further processing section 31. Here it is sanded on both sides and calibrated to uniform thickness. It is then end and edge straightened and trimmed and then formed into laminated products such as panels and structural products. At link 32 the products are moved into the UV Coating process, plus packaging of the finished products, stage 33.

Wood which has been compressed by the process according to this invention is able to retain its compressed configuration so as to take permanent advantage of its new wood strength, hardness, anti abrasiveness and dimensional stability.

Reference

Inoue et.al., "*Permanent Fixation of Compression Deformation of Wood. (II) Mechanisms of Permanent Fixation*", Presented at Conference: Chemical Modification of Lignocelluloses, 7–8 Nov. 1992, Rotorua, New Zealand.

The invention claimed is:

1. A method of forming a compressed wood product comprising the steps of:

subjecting a piece or pieces of softwood, with a moisture content of approximately 30–40% (w/w) to a first heating compression step in which the density of the softwood is increased to a first predetermined level and the moisture content is reduced to between approximately 3–8% (w/w), releasing said wood from said first compression step, coating and impregnating said compressed wood with a fatty acid, subjecting said impregnated compressed wood to a second heating compression step in which the density of said compressed wood is increased to a second predetermined level and the moisture content is further reduced and in which said fatty acid is further impregnated into said compressed wood, and releasing said wood from said second compression step and allowing said impregnated compressed wood to anneal while cooling to ambient temperature.

2. The method as claimed in claim 1, wherein said softwood is subjected to a preliminary drying step prior to said first compression step.

3. The method as claimed in claim 1, wherein said first compression step is conducted at a pressure of from 50 to 114 kg/cm$^2$ according to wood species.

4. The method as claimed in claim 1, wherein the temperature of said first compression step is within the range of 140° C. to 185° C.

5. The method as claimed in claim 1, wherein said softwood is subjected to a temperature of up to 200° C. prior to said first compression step.

6. The method as claimed in claim 1, wherein said compressed wood is impregnated by passing it through a heated bath only, or in combination with a vacuum pressure chamber.

7. The method as claimed in claim 6, wherein said fatty acid is in a paraffin carrier.

8. The method as claimed in claim 1, wherein said fatty acid is a member of the group consisting of stearic acid, palmitic acid and a combination thereof.

9. The method as claimed in claim 1, wherein said second compression step is conducted at a temperature between 60° C. and 140° C.

10. The method as claimed in claim 1, wherein said wood is subjected to a preliminary drying step to reduce its moisture content before said first compression step.

11. The method as claimed in claim 10, wherein said wood is subjected to an intermediate step of immersion in hot water or superheated steam between said preliminary drying step and said first compression step.

12. The method as claimed in claim 1, wherein said compressed wood from the said second compression step is subjected to further processing.

13. A method of forming a compressed wood product comprising the steps of:

subjecting a piece or pieces of diffuse porous hardwood, with a moisture content of approximately 40–50% (w/w) to a first heating compression step in which the density of the hardwood is increased to a first predetermined level and the moisture content is reduced to approximately 4–8% (w/w), releasing wood from said first compression step and coating and impregnating said compressing wood with a fatty acid, optionally, when said wood is hardwood, subjecting said impregnating compressed wood to a second heated compression step in which the density of said compressed wood is increased to a second predetermined level and the moisture content is reduced to suit end product requirements, at as low as 2–4% (w/w) and in which said fatty acid is further impregnated into said compressed wood, and releasing said wood from said second compression step and allowing said impregnated compressed wood to anneal while cooling to ambient temperature.

14. The method as claimed in claim 13, wherein said hardwood is subjected to a preliminary drying step prior to said first compression step.

15. The method as claimed in claim 14 wherein said wood is subjected to a preliminary drying step to reduce its moisture content prior to steam heating and before said first compression step.

16. The method as claimed in claim 15, wherein said wood is subjected to an intermediate step of immersion in hot water or superheated steam.

17. The method as claimed in claim 14, wherein said compressed wood from the said second compression step is subjected to further processing.

18. The method as claimed in claim 13, wherein said first compression step is conducted at a pressure of from 50 to 114 $kg/cm^2$ according to wood species.

19. The method as claimed in claim 13, wherein the temperature of said first compression step is within the range of 140° C. to 185° C.

20. The method as claimed in claim 13, wherein said softwood is subjected to a temperature of up to 200° C. prior to said first compression step.

21. The method as claimed in claim 13, wherein said compressed wood is impregnated by passing it through a heated bath only, or in combination with a vacuum pressure chamber.

22. The method as claimed in claim 21, wherein said fatty acid is in a paraffin carrier.

23. The method as claimed in claim 13, wherein said fatty acid is a member of the group consisting of stearic acid, palmitic acid and a combination thereof.

24. The method as claimed in claim 13, wherein said second compression step is conducted at a temperature between 60° C. and 140° C.

* * * * *